US008243000B2

(12) United States Patent
Lim

(10) Patent No.: US 8,243,000 B2
(45) Date of Patent: Aug. 14, 2012

(54) DRIVING IC OF LIQUID CRYSTAL DISPLAY

(75) Inventor: Kyoung Moon Lim, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 690 days.

(21) Appl. No.: 10/865,809

(22) Filed: Jun. 14, 2004

(65) Prior Publication Data

US 2005/0093809 A1 May 5, 2005

(30) Foreign Application Priority Data

Jun. 20, 2003 (KR) ..... 10-2003-0040013

(51) Int. Cl.
*G09G 3/36* (2006.01)

(52) U.S. Cl. ..... 345/98; 345/100

(58) Field of Classification Search ..... 345/204, 345/690, 87, 89, 98, 99, 100
See application file for complete search history.

(56) References Cited

U.S. PATENT DOCUMENTS

| | | | | |
|---|---|---|---|---|
| 3,942,117 | A * | 3/1976 | Cunningham | 375/309 |
| 4,490,742 | A * | 12/1984 | Wurtzinger | 348/601 |
| 4,810,909 | A * | 3/1989 | Asazawa | 327/544 |
| 5,382,843 | A * | 1/1995 | Gucyski | 326/109 |
| 5,502,417 | A * | 3/1996 | Uriya | 327/541 |
| 6,002,761 | A * | 12/1999 | Sremac | 379/373.04 |
| 6,115,020 | A * | 9/2000 | Taguchi et al. | 345/99 |
| 6,281,708 | B1 * | 8/2001 | Kenny | 326/86 |
| 6,316,997 | B1 * | 11/2001 | Tammone, Jr. | 330/254 |
| 6,331,844 | B1 * | 12/2001 | Okumura et al. | 345/87 |
| 6,414,530 | B2 * | 7/2002 | Noda et al. | 327/269 |
| 6,583,779 | B1 * | 6/2003 | Ushirono | 345/100 |
| 6,679,041 | B2 * | 1/2004 | Viaud et al. | 56/341 |
| 6,756,962 | B1 * | 6/2004 | Akimoto et al. | 345/98 |
| 6,806,860 | B2 * | 10/2004 | Saito et al. | 345/98 |
| 7,136,058 | B2 * | 11/2006 | Nakamura et al. | 345/211 |
| 7,154,350 | B2 * | 12/2006 | Seki | 331/158 |
| 7,196,563 | B2 * | 3/2007 | Yuki et al. | 327/205 |
| 2003/0006979 | A1 * | 1/2003 | Tsuchi et al. | 345/204 |
| 2003/0067359 | A1 * | 4/2003 | Darabi et al. | 331/46 |

FOREIGN PATENT DOCUMENTS

| | | |
|---|---|---|
| KR | 2002-0079531 | 10/2002 |
| KR | 2002-0090315 | 12/2002 |

* cited by examiner

*Primary Examiner* — Duc Dinh
(74) *Attorney, Agent, or Firm* — McKenna, Long and Aldridge, LLP.

(57) ABSTRACT

A data driver IC of a liquid crystal display is provided. The data driver IC includes a latch circuit latching digital pixel data, a digital-to-analog converter converting an output of the latch circuit into an analog video signal, and an analog amplifier amplifying the analog video signal converted in the digital-to-analog converter. The analog amplifier includes a NAND gate, a capacitor connected to an input terminal of the NAND gate, and a switch for connecting the input terminal and an output terminal of the NAND gate.

5 Claims, 6 Drawing Sheets

DRIVING IC OF LIQUID CRYSTAL DISPLAY

This application claims the benefit of Korean Patent Application No. 2003-40013, filed on Jun. 20, 2003, which is hereby incorporated by reference for all purposes as if fully set forth herein.

BACKGROUND OF THE INVENTION

1. Field of the Invention

The present invention relates to a driving integrated circuit (IC) for a liquid crystal display, and more particularly, to a driving IC for a liquid crystal display that can overcome RC delay of data lines in which the driving IC is integrated with the liquid crystal display.

2. Discussion of the Related Art

Liquid crystal displays (LCDs) have become widely used for displaying various images including still pictures or moving pictures, and their use has become more widespread with the accelerated improvement of picture quality from improved liquid crystal material and development of pixel processing techniques as well as the display's advantages of lightweight, slimness, and low power consumption.

An active matrix LCD (AM-LCD) generally includes an array substrate as a lower substrate of a liquid crystal panel for displaying images. On the array substrate, a plurality of pixels are arranged in a matrix configuration, a plurality of thin film transistors (TFTs) functioning as a switching element are also formed, and a plurality of gate lines and a plurality of data lines crossing the plurality of gate lines are arranged.

FIG. 1 is a block diagram of a related art AM-LCD.

Referring to FIG. 1, the related art AM-LCD includes a data driver IC 3 for providing a liquid crystal panel 6 with image data inputted by an external video card 1, a gamma voltage IC 4 for supplying a signal voltage to the data driver IC 3, a gate driver IC 5, which provides the liquid crystal panel 6 with a scanning signal for controlling a switching operation of thin film transistors of the liquid crystal panel 6, and a controller 2 for controlling the data driver IC 3 and the gate driver IC 5.

The liquid crystal panel 5 with a resolution of XGA (1024*768 pixels) level has 1024*3 (RGB) data lines. For instance, in an LCD with an XGA resolution, 8 data driver ICs each having 384 output terminals and 4 gate driver ICs each having 200 output terminals are used.

Video data provided by a video card in a main body of a computer is supplied to the data driver IC 3 by a relay of the controller 2. In another example, an analog image signal inputted from a computer is converted into digital video data by an interface module in an LCD monitor, which then inputs the converted digital video data into the LCD.

The gate driver IC 5 applies a scanning pulse once per frame period to each scanning line. The timing of the scanning pulse is interlaced from an upper side of the liquid crystal panel to a lower side. The data driver IC 3 applies a liquid crystal driving voltage, which corresponds to pixels of the row to which the scanning pulse is applied, i.e., it applies a signal voltage to each data line.

In selected pixels to which the scanning pulse is applied, as voltages of corresponding gate electrodes connected to the data line increases, corresponding thin film transistors are turned on.

At this time, the liquid crystal driving voltage is applied to the liquid crystal from the data line via the drain electrode and the source electrode of each of the thin film transistors, so that each of the corresponding pixels charges a pixel capacitance corresponding to a sum of liquid crystal capacitance and storage capacitance. By repeating the above operation, a voltage corresponding to an image signal is applied repeatedly per frame period to a pixel capacitance of the liquid crystal panel.

FIG. 2 is a block diagram of the data driver IC of FIG. 1.

Referring to FIG. 2, a data latch 41 latches video data input on lines 10, 11 and 12 from outside the data drive IC 3. When the LCD receives even and odd video data, the data latch 41 latches input video data in groups of two pixels.

A shift register 40 sequentially generates latch enable signals, which are synchronized with an external input clock signal to store video data in a line latch 42.

The line latch 42 sequentially stores the video data, which are synchronized with the latch enable signals and inputted by the shift register 40.

The line latch 42 includes first and second registers each having at least one line size (number of data lines connected to one data driver IC, for example, 386 6 bits). Once video data corresponding to one line is stored in the first register, the line latch 42 transfers the video data corresponding to one line stored in the first register to the second register. Thereafter, the line latch 42 sequentially stores video data for a next line.

A digital-to-analog converter 43 of the data driver IC divides a selected digital signal voltage into several voltages, converts the divided voltages into analog voltages, and outputs the converted analog voltages to data lines as an image signal through an output buffer 44.

In the related art LCD, a driving IC board, i.e., a board provided with a data driver IC and a gate driver IC is installed separate from the liquid crystal panel.

However, as low temperature polysilicon allows the use of larger-sized glass substrates and, as the integration technology of drive ICs advances, it becomes possible to integrate circuits related to the processing of display signals on the glass substrate. Also, the number and variety of circuits that can be integrated on the glass substrate increases as well.

In other words, the above system-on-LCD includes polysilicon TFTs formed on glass substrates for use in both the pixel array and the drive ICs of a liquid crystal panel.

Because polysilicon has a much higher carrier mobility than amorphous silicon, transistors for drive ICs can be formed on a glass substrate along with the switching transistors for the pixel electrodes. Thus, the fabrication costs of modules in LCDs can be reduced and at the same time power consumption can be also reduced.

However, in the system-on-LCD, load capacitance of the data bus lines increases, because so many data bus lines are formed on the glass substrate, because the size of the glass substrate increases and also because the number of data lines increases. If the load capacitance is increased, problems occur in that waveforms becomes smooth and RC load of the data line is increased.

In the case of the system-on-LCD, the analog voltage must be output from the data driver more stably. For this purpose, the output buffer is required to operate stably with a high output.

SUMMARY OF THE INVENTION

Accordingly, the present invention is directed to a liquid crystal display module that substantially obviates one or more problems due to limitations and disadvantages of the related art.

An advantage of the present invention is to provide a data driver IC of a liquid crystal display in a system-on-LCD, which is capable of stably driving signal lines having a large Reload by providing an analog amplifier that includes a NAND gate and a switch for connecting input/output terminals of the NAND gate.

Additional advantages, and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a data driver IC of a liquid crystal display, which includes: a latch circuit that latches digital pixel data; a digital-to-analog converter that converts an output of the latch circuit into an analog video signal; and an analog amplifier that amplifies the analog video signal converted in the digital-to-analog converter. The analog amplifier may include: a NAND gate; a capacitor connected to an input terminal of the NAND gate; and a switch that connects the input terminal and an output terminal of the NAND gate.

The NAND gate may have two input terminals that are shorted with each other, such that the same analog video signals are inputted.

Also, the NAND gate may have two input terminals, in which the analog video signal is input to a first input terminal and an additional control signal is input to a second input terminal.

A plurality of analog amplifiers constructed as above are connected in cascade.

In another aspect of the present invention, there is provided a data driver IC of a liquid crystal display, which includes: a latch circuit that latches digital pixel data; a digital-to-analog converter that converts an output of the latch circuit into an analog video signal; and an analog amplifier that amplifies the analog video signal converted in the digital-to-analog converter, wherein the analog amplifier includes: a NOR gate; a capacitor connected to an input terminal of the NOR gate; and a switch that connects the input terminal and an output terminal of the NOR gate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
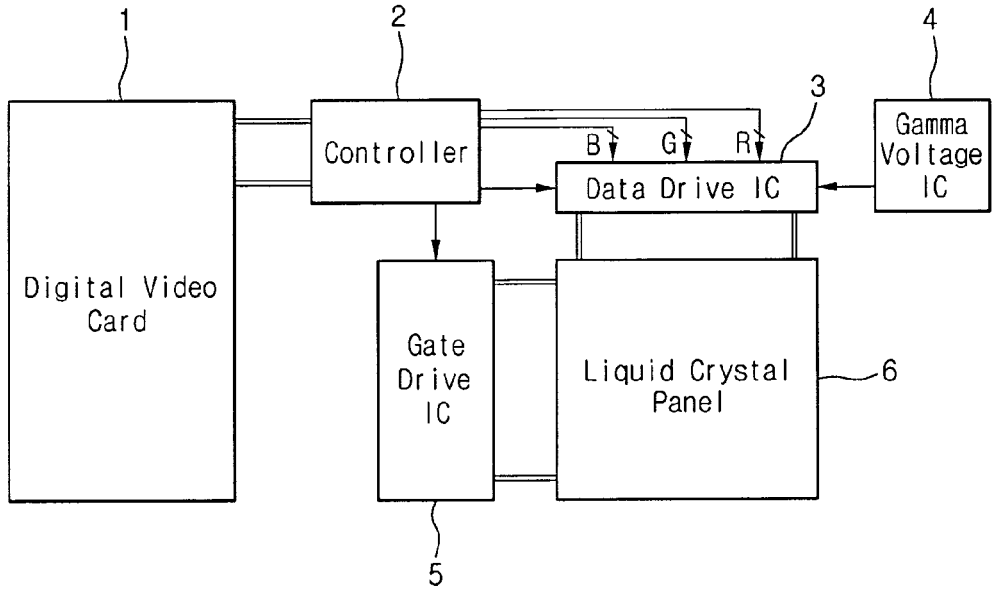
Fig.1 Related Art
FIG. 1 is a block diagram of a related art AM-LCD.
Figure 2:
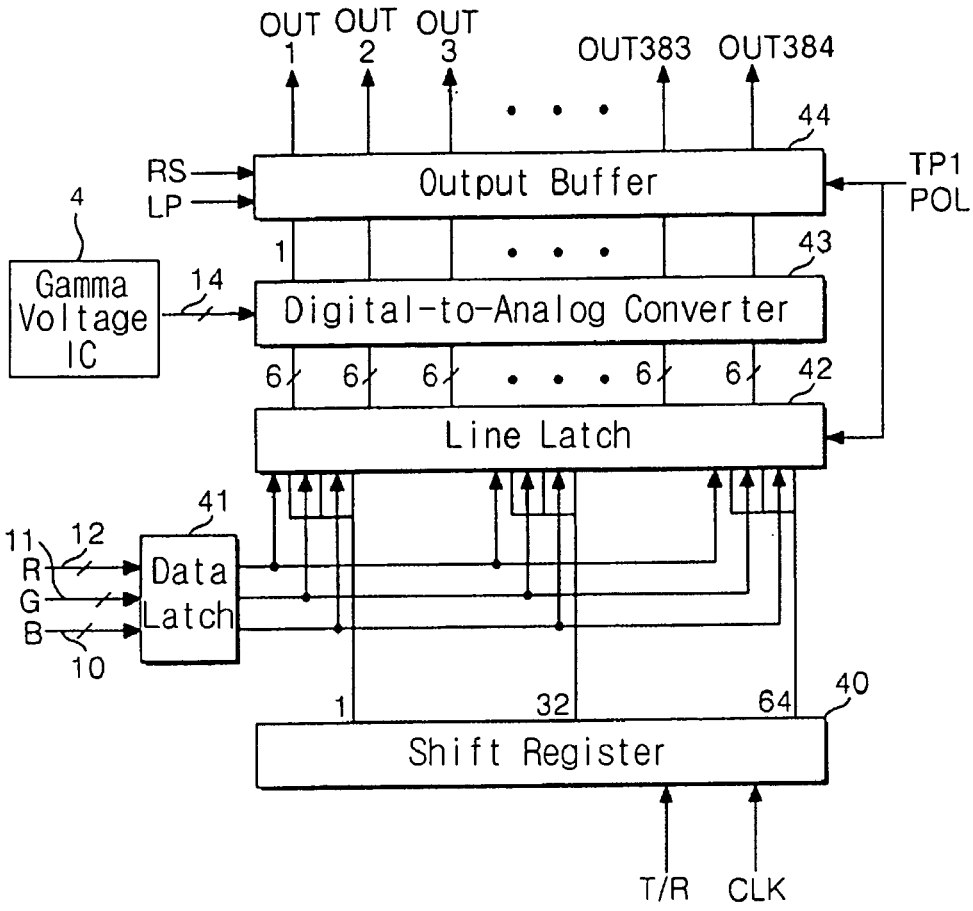
Fig.2 Related Art
FIG. 2 is a block diagram of the data driver IC of FIG. 1.
Figure 3:
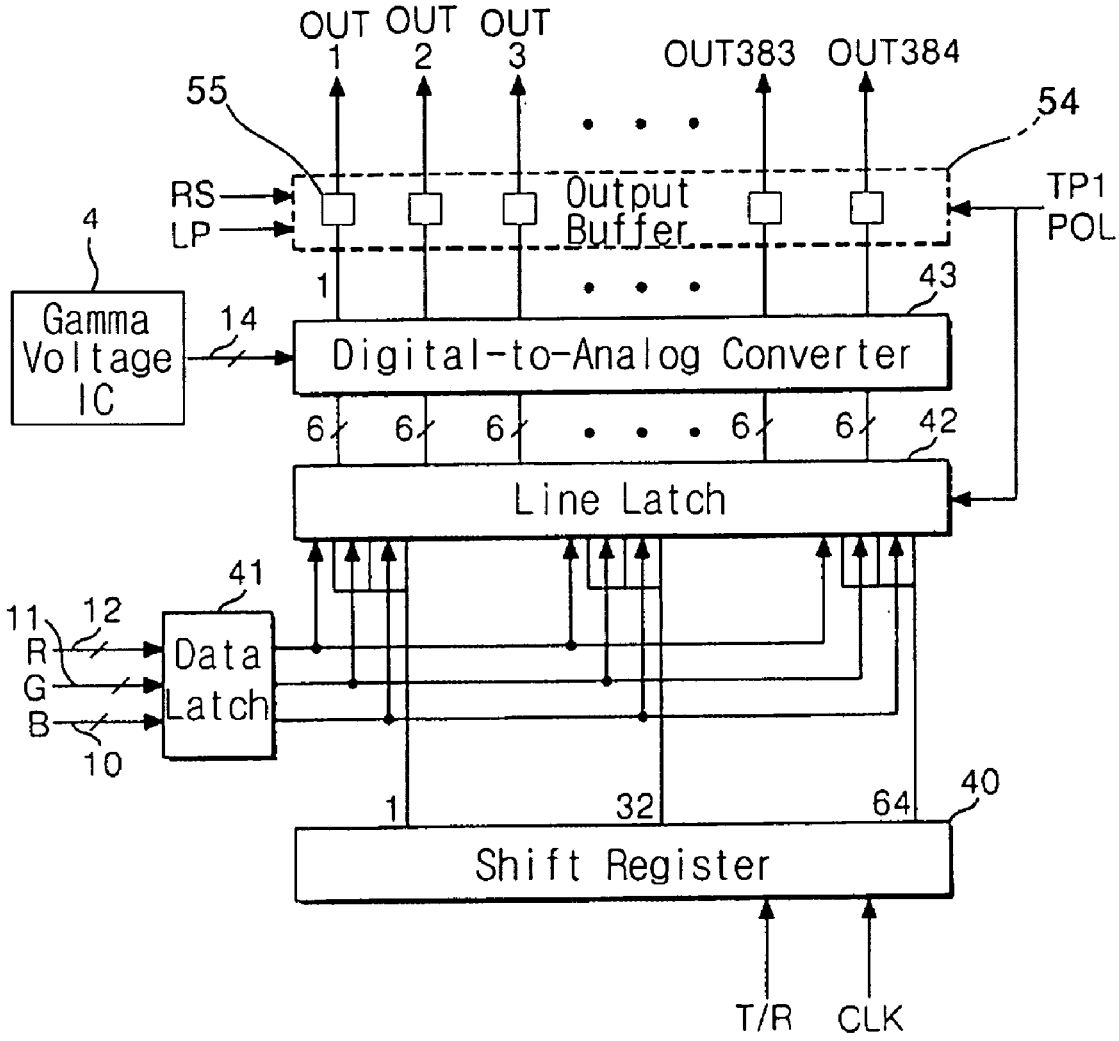
FIG. 3 is a circuit diagram of a data driver IC according to the present invention.

FIG. 3 is a block diagram of a data driver IC according to the present invention.

It is assumed that the data driver IC according to the present invention is formed on the same substrate as a pixel array of a liquid crystal panel. For this purpose, the active layer of a thin film transistor (TFT) formed on the substrate is formed of polysilicon.

Referring to FIG. 3, the data driver IC according to the present invention includes a latch circuit, a digital-to-analog converter, and an analog amplifier. Also, the latch circuit includes a data latch, a shift register, and a line latch. The operation of the data driver IC will now be described.

The data latch 41 latches external video data on lines 10, 11 and 12 one pixel at a time. If an LCD receives even and odd video data, the data latch 41 latches the input video data in groups of two pixels.

The shift register 40 sequentially generates a latch enable signal for storing the video, data in the line latch in synchronization with an external clock signal. The line latch 42 sequentially stores the video data that are input in synchronization with the latch enable signal.

The line latch 42 includes first and second transistors (not shown) each having at least one line size (for example, the number of data lines connected to one data driver IC: 368*6 bits). If the video data for one line is stored in a first register, the line latch 42 shifts the stored video data to a second register at the same time. Then, the line latch 42 sequentially stores video data for a next line in the first register.

The digital-to-analog converter 43 receives a plurality of signal voltages from a gamma voltage IC 4. Then, the digital-to-analog converter 43 selects at least one or two signal voltages from among the plurality of the signal voltages input corresponding to the respective video data that are supplied from the second register of the line latch.

The digital-to-analog converter 43 converts the selected signal voltages into analog video signals corresponding to the video data. The converted analog video signals are amplified and output through an output buffer 54.

The output buffer 54 is configured with a plurality of analog amplifiers 55. The plurality of analog amplifiers 55 are provided corresponding to the respective data lines in order to amplify and transfer the respective analog video signals to the respective data lines.

In the case of a system-on-LCD, the load capacitance of the data bus lines increases, because so many data bus lines are formed on the glass substrate, because the size of the glass substrate increases and because the number of data lines increases. As a result, the RC load of the data line increases.

In order to resolve these problems, the analog video data must be output to the data lines more stably. To achieve this purpose, the analog amplifier according to the present invention is constructed differently from that of the related art.

Figure 4A:
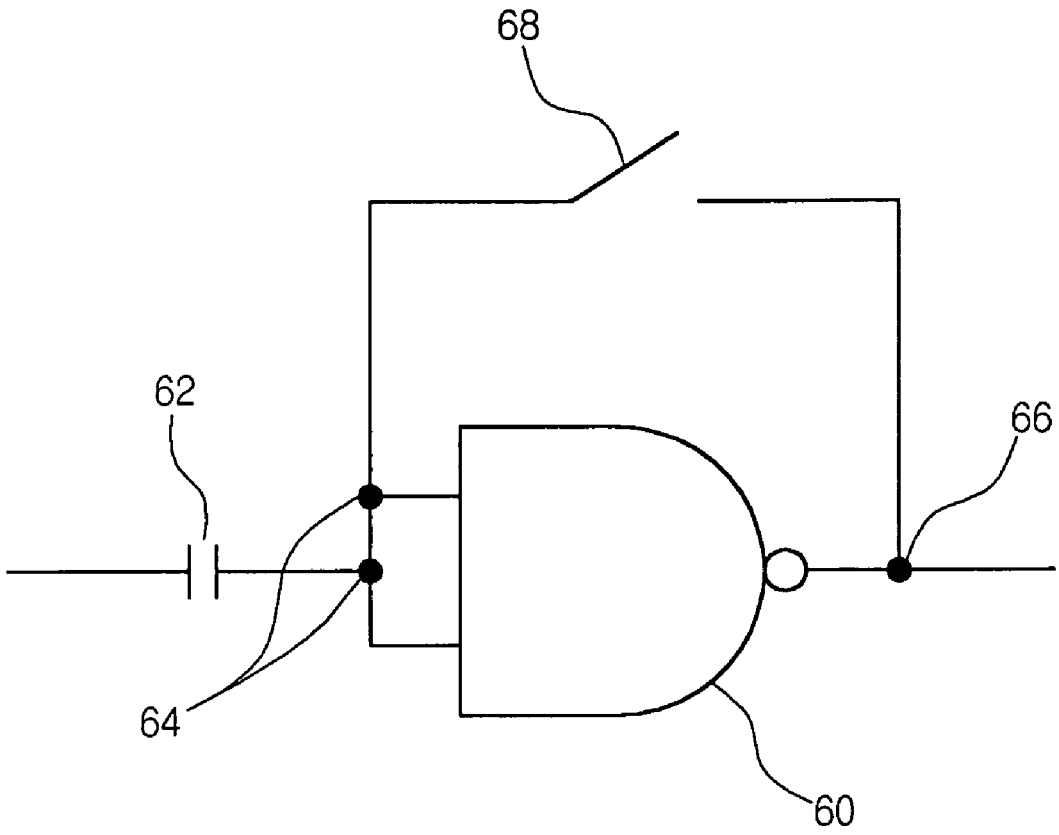
FIGS. 4A to 4C are circuit diagrams of an analog amplifier according to the present invention.
Figure 4B:
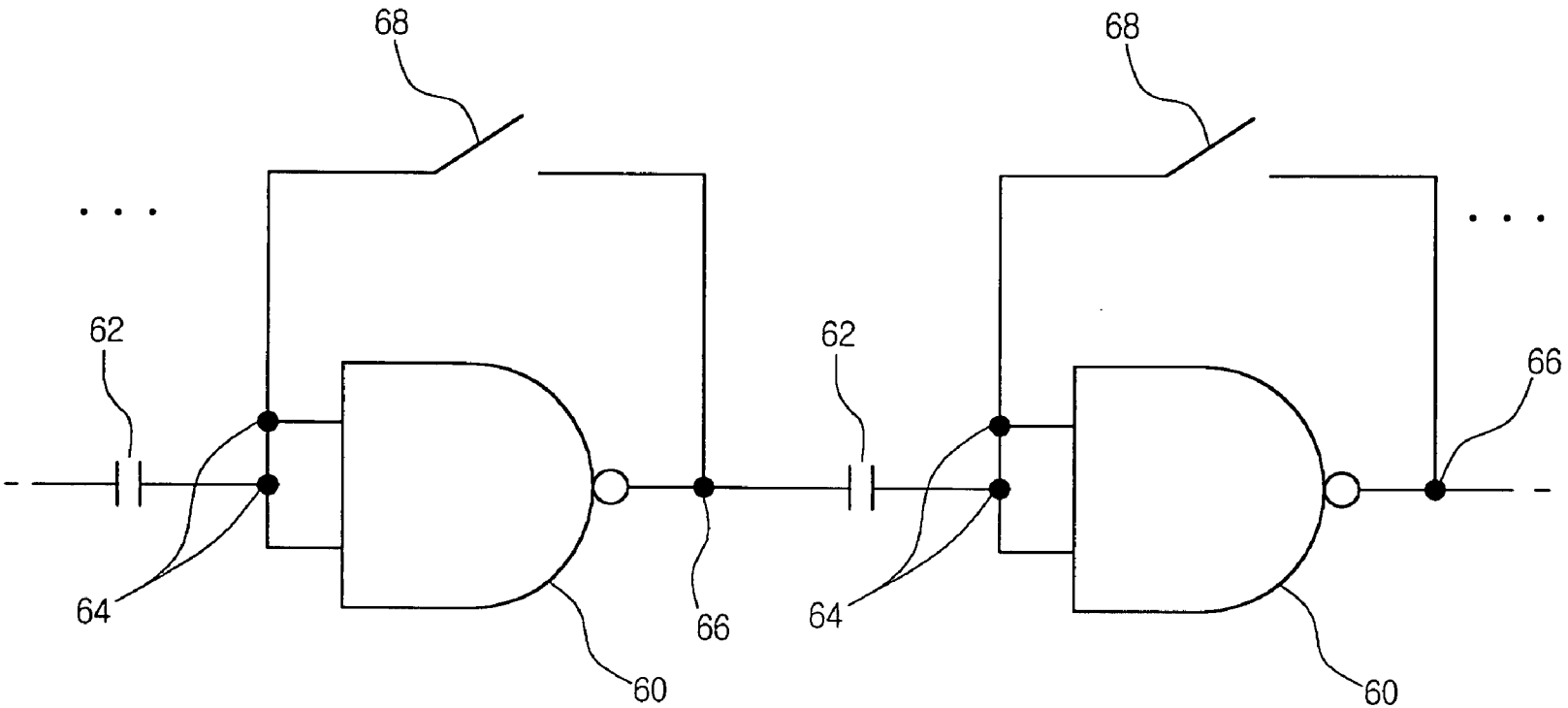
Figure 4C:
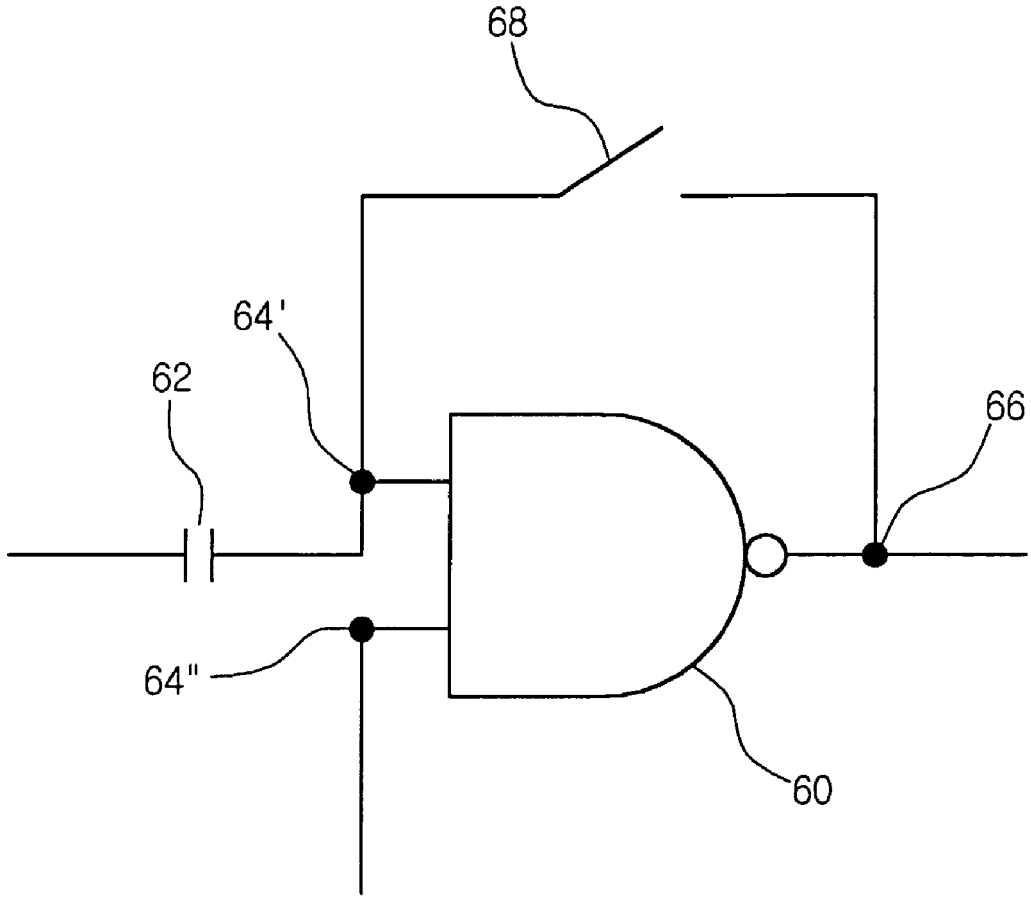

FIGS. 4A to 4C are circuit diagrams of the analog amplifier 55. The analog amplifier 55 is provided inside the output buffer 54 of the data driver IC shown in FIG. 3.

Referring to FIG. 4A, the analog amplifier includes a NAND gate 60, a capacitor 62 connected to input terminals 64 of the NAND gate 60, and a switch 68 for connecting the input terminals 64 and an output terminal 66 of the NAND gate 60.

The NAND gate 60 has two input terminals 64. The two input terminals 64 are connected and thus receive the same analog video signal. Also, the switch 68 is provided for initializing a voltage.

The operation of the analog amplifier will now be described. First, the switch 68 is closed to initialize the input and output of the NAND gate 60 to an intermediate potential of a power supply voltage that is applied to the NAND gate 60. The initialized voltage is stored in the capacitor 62, which is connected to the input terminal 64 of the NAND gate 60.

Then, the analog video signal is input through the input terminals 64 of the NAND gate 60. A voltage corresponding to a difference between the voltage of the analog video signal and the initialized voltage is output through the output terminal 66 of the NAND gate 60.

As a result, the analog voltage that is output through the output terminal 66 of the NAND gate 60 is an amplified value of the analog video signal that is converted in the digital-to-analog converter (43, in FIG. 3). The analog voltage is transferred to a corresponding data line.

In other words, the signal output to the data line is monitored and fed back to the analog video signal that is converted in the digital-to-analog converter (43, in FIG. 3). Through this operation, the voltage output through the analog amplifier (55, in FIG. 3) may be controlled. As a result, the analog output signals of the data driver IC may be transferred to the data lines more stably through the signal control.

FIG. 4B is a circuit diagram illustrating another exemplary embodiment of the analog amplifier.

The analog amplifier according to another embodiment of the present invention includes a plurality of analog amplifiers that are cascaded. Each analog amplifier includes a NAND gate 60, a capacitor 62 connected to input terminals 64 of the NAND gate 60, and a switch 68 for connecting the input terminal 64 and an output terminal 66 of the NAND gate 60. Such a configuration allows for improved signal offset.

FIG. 4C is a circuit diagram illustrating further another embodiment of the analog amplifier. In this embodiment, the analog amplifier includes a NAND gate 60, a capacitor 62 connected to input terminal 64' of the NAND gate 60, and a switch 68 for connecting the input terminal 64' and an output terminal 66 of the NAND gate 60, which is similar to the configuration of FIG. 4A. However, the analog video signal converted in the digital-to-analog converter (43, in FIG. 3) is input to one input terminal 64' of the NAND gate 60, and an additional control signal is inputted to the other terminal 64".

The input terminal 64' and the output terminal 66 of the NAND gate 60 are connected by the switch 68.

If either or both of the two input terminals are a logic low level, the NAND gate always outputs a logic high level. In other words, if an additional control signal is applied to either or both of the two input terminals 64' and 64 a user may force the output state to be locked.

For example, this may be applied to lock the output analog video signal to black depending on the upper bit state of the digital bit, a multi-color mode selection function, or a screen mask, for example.

In the analog amplifiers of FIGS. 4A to 4C, if necessary, the NAND gate may be replaced with NOR gate (not shown). Because an operation of the analog amplifier configured with NOR gate is similar to that of the analog amplifier configured with NAND gate, its description will be omitted.

Also, the analog amplifier may be configured with XOR gates.

According to the drive, IC of the present invention, in a system-on-LCD, the analog output signals of the drive IC may be transmitted to the signal lines more stably, thereby integrating the drive IC more effectively.

It will be apparent to those skilled in the art that various modifications and variations can be made in the present invention. Thus, it is intended that, the present invention covers the modifications and variations of this invention provided they come within the scope of the appended claims and their equivalents.

What is claimed is:

1. A data driver IC for a liquid crystal display, comprising:

a latch circuit latching digital data;

a digital-to-analog converter converting an output of the latch circuit into an analog video signal; and a plurality of analog amplifiers amplifying the analog video signal converted in the digital-to-analog converter, wherein the analog amplifiers are cascade-connected to each other, wherein each of the analog amplifiers comprises:

a NAND gate formed of a polysilicon and having two input terminals that are connected to each other, such that the same analog video signal is input on both of the terminals;

a capacitor connected to any one of the input terminals of the NAND gate; and a switch connecting the two input terminals and an output terminal of the NAND gate, such that an output signal from the NAND gate is fed back to both of the two input terminals through an operation of the switch, wherein when the switch is closed to initialize the input and the output terminals of the NAND gate to an intermediate potential of a power supply voltage that is applied to the NAND gate, an initialized voltage is stored in the capacitor, and then a voltage corresponding to a difference between a voltage of an analog video signal supplied to the capacitor and the initialized voltage is output to a data line through the output terminal, wherein the output signal is an amplified value of the analog video signal that is converted in the digital-to analog converter and is stabilized to a RC delay of the data line, and wherein the output signal is monitored and fed back to the analog video signal that is converted in the digital-to analog converter.

2. The data driver IC according to claim 1, wherein the latch circuit comprises:

a data latch latching external digital data;

a shift register sequentially generating latch enable signals with respect to the digital data in synchronization with an external clock signal; and a line latch sequentially storing the digital data that are input in synchronization with the latch enable signal.

3. A data driver IC for a liquid crystal display, comprising:

a latch circuit latching digital data;

a digital-to-analog converter converting an output of the latch circuit into an analog video signal; and a plurality of analog amplifiers amplifying the analog video signal converted in the digital-to-analog converter, wherein the analog amplifiers are cascade-connected to each other, wherein each of the analog amplifiers comprises:

a NOR gate formed of a polysilicon and having two input terminals that are connected to each other, such that the same analog video signal is input on both of the terminals;

a capacitor connected to any one of the input terminals of the NOR gate; and a switch connecting the input terminals and an output terminal of the NOR gate, such that an output signal from the NOR gate is fed back to both of the two input terminals through an operation of the switch, wherein when the switch is closed to initialize the input and the output terminals of the NOR gate to an intermediate potential of a power supply voltage that is applied to the NOR gate, an initialized voltage is stored in the capacitor, and then a voltage corresponding to a difference between a voltage of an analog video signal supplied to the capacitor and the initialized voltage is output through the output terminal, wherein the output signal is an amplified value of the analog video signal that is converted in the digital-to analog converter and is stabilized to a RC delay of the data line, and wherein the output signal is monitored and fed back to the analog video signal that is converted in the digital-to analog converter.

4. The data driver IC according to claim 3, wherein the latch circuit comprises:

a data latch latching external digital data;

a shift register sequentially generating latch enable signals with respect to the digital data in synchronization with an external clock signal; and a line latch sequentially storing the digital data that are input in synchronization with the latch enable signal.

5. A data driver IC for a liquid crystal display, comprising:

a latch circuit latching digital data;

a digital-to-analog converter converting an output of the latch circuit into an analog video signal; and an analog amplifier amplifying the analog video signal converted in the digital-to-analog converter, wherein the analog amplifier comprises:

a NAND gate having two input terminals, the analog video signal is supplied to a first input terminal and a control signal is supplied to a second input terminal;

a capacitor connected to the first input terminal of the NAND gate; and a switch connecting the first input terminal and an output terminal of the NAND gate, wherein the control signal is a signal for locking the analog video signal to a black state depending on an upper bit state of the analog video signal, a multi-color mode selection function or a screen mask, wherein when the switch is closed to initialize the first input and the output terminals of the NAND gate to an intermediate potential of a power supply voltage that is applied to the NAND gate, an initialized voltage is stored in the capacitor, and then a voltage corresponding to a difference between a voltage of an analog video signal supplied to the capacitor and the initialized voltage is output to a data line through the switch, wherein the difference voltage is an amplified value of the analog video signal that is converted in the digital-to analog converter, and wherein the difference voltage output to the data line is monitored and fed back to the analog video signal that is converted in the digital-to analog converter to control the difference voltage, wherein in a case when the control signal has a logic low level by a user an output state is locked.

* * * * *